US007403450B2

(12) United States Patent
Ozawa

(10) Patent No.: US 7,403,450 B2
(45) Date of Patent: Jul. 22, 2008

(54) TIMEPIECE

(75) Inventor: Noriaki Ozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/837,234

(22) Filed: Aug. 10, 2007

(65) Prior Publication Data

US 2008/0049561 A1 Feb. 28, 2008

(30) Foreign Application Priority Data

Aug. 24, 2006 (JP) ..... 2006-227617
May 31, 2007 (JP) ..... 2007-144618

(51) Int. Cl.
*G04B 19/00* (2006.01)
*G04B 21/00* (2006.01)
*G04B 37/00* (2006.01)

(52) U.S. Cl. ..... 368/269; 368/291; 368/309

(58) Field of Classification Search ..... 368/72–74, 368/88, 243, 244, 250, 255, 267–271, 281, 368/291–292, 309, 315
See application file for complete search history.

(56) References Cited

U.S. PATENT DOCUMENTS 3,577,876 A * 5/1971 Spadini ..... 368/250
3,777,472 A * 12/1973 Iinuma ..... 368/255
4,167,849 A * 9/1979 Takahashi ..... 368/291
5,726,626 A * 3/1998 Jabbour et al. ..... 340/407.1
6,014,347 A * 1/2000 Mignot et al. ..... 368/88
6,219,304 B1 * 4/2001 Mignot et al. ..... 368/88
6,321,868 B1 * 11/2001 Mignot et al. ..... 181/120

FOREIGN PATENT DOCUMENTS

| | | | |
|---|---|---|---|
| EP | 1 154 583 | A2 | 11/2001 |
| JP | 55-20464 | A | 2/1980 |
| JP | 55-69078 | A | 5/1980 |
| JP | 55-80082 | A | 6/1980 |
| JP | H08-334574 | A | 12/1996 |
| JP | H09-318774 | A | 12/1997 |
| JP | H10-126713 | A | 5/1998 |
| JP | 2815618 | B | 8/1998 |
| JP | H11-133157 | A | 5/1999 |
| JP | 2001-345907 | A | 12/2001 |

* cited by examiner

*Primary Examiner*—Vit W Miska
(74) *Attorney, Agent, or Firm*—Global IP Counselors, LLP

(57) ABSTRACT

A timepiece having an external case, a sound source disposed inside the external case, an internal filter that is gas permeable and waterproof and is disposed opposite with a gap to the external case and the sound source, and a communication opening that communicates the space between the external case and the internal filter with the outside. The internal filter is a porous thin film that has a large number of small holes and assures waterproofness preventing water from passing the small holes for at least ten minutes when in contact with water at normal pressure.

12 Claims, 5 Drawing Sheets

TIMEPIECE

BACKGROUND

1. Field of Invention

The present invention relates to a timepiece, and relates more particularly to a sound emission structure for a timepiece that has an internal sound source and a communication opening rendered at the outside case member for emitting the sound produced by the sound source.

2. Description of Related Art

A structure having a gas-permeable waterproof film disposed between an audio device and a channel that communicates with the outside as the waterproof structure of a timepiece that has an audio device such as a speaker or microphone is known from the literature (see, for example, Japanese Unexamined Patent Appl. Pub. JP-A-H11-133157).

Wristwatches that use a piezoelectric vibrator as a sound source, attach the back cover with a waterproof film between the back cover and the case member, enable hearing the sound produced by the piezoelectric vibrator either through the back cover or a sound emission opening disposed between the back cover and the case member, and maintain the required waterproofness by means of the waterproof film, are also known from the literature (see, for example, Japanese Unexamined Patent Appl. Pubs. JP-A-H08-334574 and JP-A-H09-318774).

Various other structures for maintaining the required waterproofness while enabling sound to be output from a speaker, for example, in electronic devices other than timepieces are also known from the literature (see, for example, Japanese Unexamined Patent Appl. Pub. JP-A-2001-345907 and JP-A-H10-126713).

A problem with the sound emission structures of the timepiece and electronic devices described above is that while these structures can sufficiently externally transmit sounds with a high sound pressure such as from a speaker, they cannot efficiently guide sounds with a low sound pressure, such as reverberation (echoes) from a bell, to the outside, and the audible sound pressure range and sound quality are therefore limited.

SUMMARY

The sound emission structure for a timepiece according to the present invention enables efficiently emitting sounds with a low sound pressure level to the outside while maintaining the required waterproofness.

A first aspect of the invention is a timepiece having an external case; a sound source disposed inside the external case; an internal filter that is gas permeable and waterproof and is disposed opposite with a gap to the external case and the sound source; and a communication opening that communicates the space between the external case and the internal filter with the outside. The internal filter is a porous thin film that has a large number of small holes and assures waterproofness preventing water from passing the small holes for at least ten minutes when in contact with water at normal pressure.

By disposing an internal filter that is gas permeable and waterproof with a gap between it and both the sound source and the external case, the internal filter does not interfere with vibration of the sound source. In addition, by setting the hole diameter of the small holes in the internal filter composed of a porous film based on the relationship between the water repellency of the filter and the surface tension of water, a certain degree of waterproofness can be achieved while also sufficiently assuring desirable transmission of sounds with low sound pressure. The necessary degree of waterproofness can therefore be assured while enabling efficient sound output without interfering with transmission of sounds at a low sound pressure level that are produced by the sound source.

Waterproofness as used herein means waterproofness to the degree that water does not penetrate for at least ten minutes when in contact with water at normal pressure. Drip-proof level waterproofness (waterproofness preventing water penetration when immersed at a water depth of 10 cm for 10 min) is further preferable.

The internal filter having a large number of small holes can be rendered as a member with an array of desirably shaped holes, or as a mesh.

Preferably, a surface of the porous film is treated for water repellency. By imparting water repellency to the surface, waterproofness can be assured even when the hole diameter of the small holes in the porous film is increased, and sound emission characteristics can therefore be improved or waterproofness can be improved. An example of water repellency treatment is coating with a fluororesin coating material.

Further preferably, the porous film is a metal porous film having the small holes formed in a metal thin film. This arrangement further improves transmission of low sound pressure sounds, is easy to manufacture, enables easily rendering the small holes with a small diameter, and can assure that the holes are precisely shaped.

Further preferably, a plurality of the internal filters are disposed between the sound source and the communication opening with a gap between the internal filters. This arrangement can suppress a drop in waterproofness when dust or other foreign matter adheres to one of the internal filters, particularly the internal filter disposed closest to the outside (the communication opening side).

Another aspect of the invention is a timepiece having an external case; a sound source disposed inside the external case; an internal filter that is gas permeable and waterproof and is disposed opposite with a gap to the external case and the sound source; and a communication opening that communicates the space between the external case and the internal filter with the outside. The internal filter includes a mesh-shaped support member, and a resin film that is gas permeable and is supported by the mesh-shaped support member from the inside.

By using a gas permeable resin film, this aspect of the invention can assure desirable sound emission, and by supporting the resin film from the inside by means of a mesh-shaped support member can better withstand external pressure and thereby can assure sufficient waterproofness.

The resin film in the invention is not specifically limited, but is preferably made of polyethylene resin or polypropylene resin. Of these, the resin film is particularly preferably a low density polyethylene film. By using a low density polyethylene film sufficient gas permeability can be achieved and the required sound emission characteristic can be acquired. The thickness of the resin film is preferably 5 μm to 20 μm, and is further preferably approximately 8 μm to 12 μm.

A timepiece according to yet another aspect of the invention has an external case; a sound source disposed inside the external case; an internal filter that is gas permeable and waterproof and is disposed opposite with a gap to the external case and the sound source; and a communication opening that communicates the space between the external case and the internal filter with the outside. The internal filter includes a plurality of gas permeable resin film layers.

By laminating plural gas permeable resin film layers together, pressure resistance can be increased and waterproofness can be improved while maintaining a desirable sound emission characteristic. More specifically, compared with simply increasing the thickness of the resin film, using a combination of plural layers of film can improve the waterproofing effect while suppressing the drop in sound emission. Pressure resistance can be further improved by supporting the internal filter composed of these plural layers of resin film from the inside by means of the mesh-shaped support member.

In another aspect of the invention the internal filter is a laminate of polyethylene film and polypropylene film. This arrangement assures gas permeability while improving waterproofness by increasing filter strength.

The laminate is preferably a laminated film manufactured by a coextrusion process. This easily enables directly laminating and rendering the film layers in unison.

The sound source preferably includes a bell, and a striking mechanism for striking and causing the bell to vibrate. Sound is produced in this arrangement by the striking mechanism striking and causing the bell to vibrate. Sounds with depth and low sound pressure reverberation or echo can thus be produced, and the internal filter can efficiently transmit these low sound pressure sounds and emit high quality sounds.

Yet further preferably, the attenuation rate of reverberations produced by the bell and measured outside the communication opening is less than or equal to 25 dB/sec. This enables the reverberations of the bell to be sufficiently felt.

Yet further preferably, the internal filter is disposed opposite a back cover, which is a part of the external case; and the communication opening is disposed at the outside circumference part of the back cover or between the back cover and another external case member.

This arrangement enables efficiently emitting sounds from or near the outside circumference part of the back cover that is in contact with the wrist or other body part, and is therefore preferable for a wristwatch, pocket watch, or other portable timepiece.

Yet further preferably, the gap between the internal filter and the back cover is greater than or equal to the value of the critical point at which the rate of change in the transmitted sound pressure emitted from the communication opening relative to the gap drops.

This enables even more efficiently emitting sounds at a low sound pressure level. More particularly, if the gap is the value of this critical point, both efficient sound emission and a thin timepiece thickness can be achieved.

A plurality of communication openings are preferably formed dispersed around the outside circumference of the external case. This enables rendering the communication openings inconspicuously while assuring sufficient open area in the communication opening.

Further preferably, a timepiece band is attached to the external case, and at least one of the plural communication openings opens to a place behind where the timepiece band attaches to the external case. This enables rendering the communication openings even more inconspicuously.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of the present invention are described below with reference to the accompanying figures.

Embodiment 1

Figure 1:
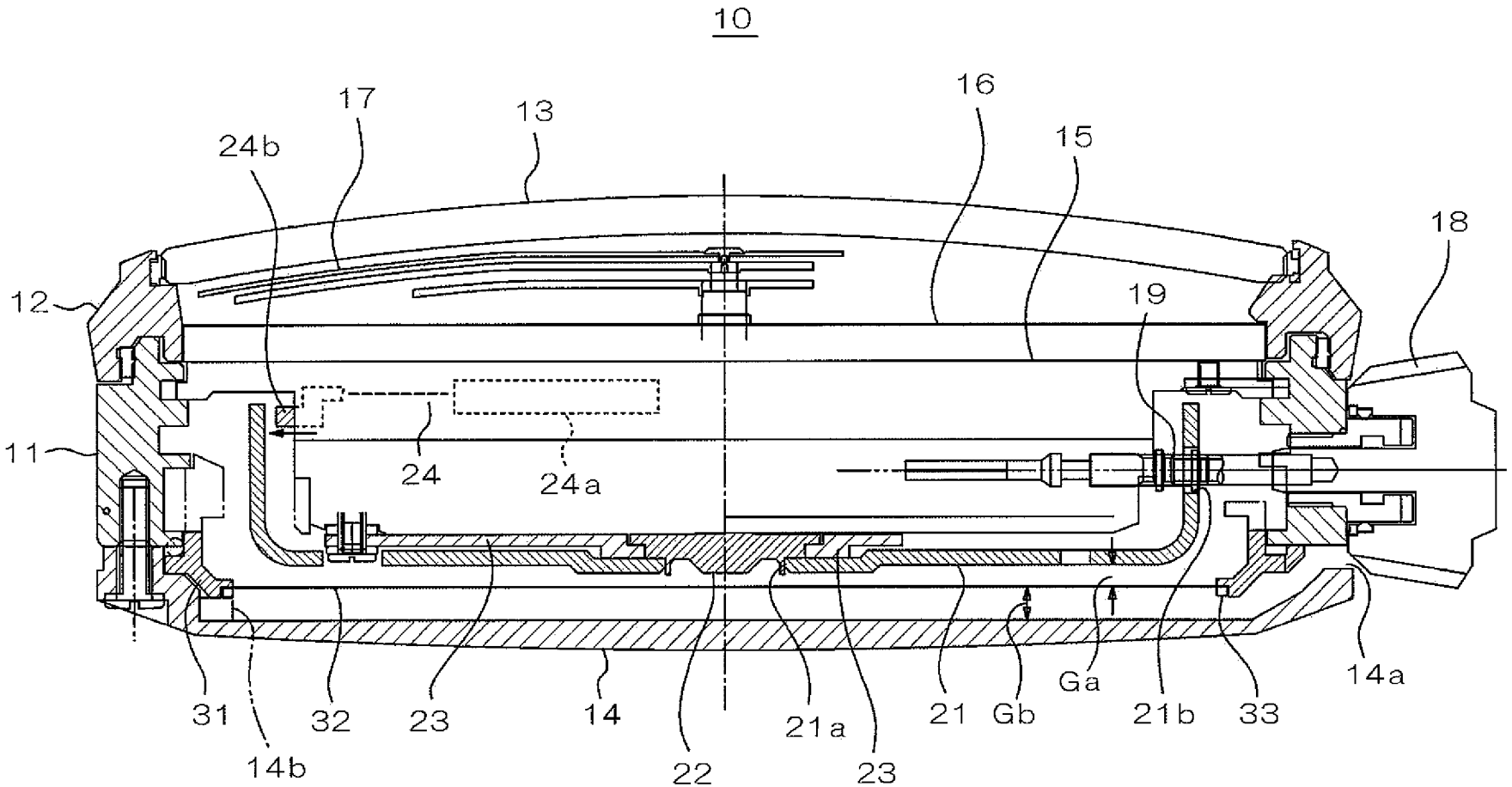
FIG. 1 is a vertical section view showing the structure of an embodiment of a timepiece according to a first embodiment of the present invention.

FIG. 1 is a vertical section view showing the structure of an embodiment of a timepiece according to a first embodiment of the present invention. The left side of the perpendicular denoted by a dot-dash line in the center of FIG. 1 shows a section view in the 12:00 to 6:00 o'clock direction of the timepiece, and the right side of the perpendicular shows a section view through the 3:00 o'clock direction of the timepiece.

The timepiece 10 in this embodiment of the invention has a case member 11, an edge member 12 that is attached to the front side of the case member 11, a crystal 13 that is a glass or other transparent member attached to the edge member 12, and a back cover 14 that is attached to the back side of the case member 11, and these parts together render the external case of the invention. A movement 15, a dial 16, and hands 17 are housed inside this external case. An operating member 18 such as a crown or push-button is disposed outside of the case on the side.

A bell 21 is housed inside the case on the back side of the movement 15. The bell 21 is affixed to the movement 15 by an intervening support member 22 that is affixed to the edge of a center hole 21*a*, and a support spring 23 that is attached to this support member 22. The bell 21 is bowl-shaped with the opening at the top in the example shown in the figure, and is positioned so that the bottom of the movement 15 is held inside without touching the bell 21.

The operating member 18 passes through the case member 11 and connects to a stem 19, and the stem 19 extends inside the movement 15. An opening 21*b* through which the stem 19 passes is formed in the bell 21 so that the stem 19 does not touch the bell 21.

The bell 21 is a vibrating body that vibrates and produces a particular sound when struck, similarly to various kinds of bells, chimes, gongs, and drums, and is generally made from a copper alloy such as brass or other metal material. The bell 21 shown in the figure is a shallow bowl-shaped bell, and when the bell 21 is struck by the striking mechanism 24, the bell 21 vibrates and produces a specific sound. The striking mechanism 24 can be rendered by any means that can strike the bell 21, and in the example shown in the figure is rendered by a mechanism (disposed above the movement 15) having a spring or other drive source 24*a* and a hammer 24*b* that is operated by the drive source 24*a*. The hammer 24*b* is normally engaged and held away from the bell 21 by a catch mechanism not shown, but when the hammer 24*b* is released by the catch mechanism by a suitable action or timer function, the drive force of the drive source 24*a* causes the hammer 24*b* to strike the inside surface of the open edge of the bell 21 from the inside.

Striking the bell 21 by means of the striking mechanism 24 excites plural vibration modes having different frequencies. For example, our calculations showed that using such a shallow bowl-shaped bell 21 that is 32 mm in diameter and is constrained at the center hole 21*a*, the natural vibration modes include one or a plurality of first vibration modes in a first mode group at 700-900 Hz, one or a plurality of second vibration modes in a second mode group at 2600-3400 Hz, and one or a plurality of third vibration modes in a third mode group at 6400-9200 Hz. The sounds produced by the vibration modes in the three mode groups also overlap and produce a reverberation or echo as described below.

An annular case ring 31 is disposed fastened to the case member 11 below the bell 21, and an internal filter 32 (such as a round filter 32 mm in diameter) is affixed to the case ring 31. Attaching an annular reinforcing plate 33 to the outside edge part of the internal filter 32 as described below makes handling easier during production and enables positively securing the internal filter 32 in the assembled state. Note that the internal filter 32 can also be held between and secured by the case ring 31 and the inside part 14*b* (denoted by the double-dot dash line in the figure) of the back cover 14 (the part where the inside surface is stepped higher).

A notched portion is disposed at the outside edge of the back cover 14, and the sound emission opening 14*a* is formed by this notched portion between the back cover 14 and the case member 11. The sound emission opening 14*a* is a communication opening that enables the space between the internal filter 32 and the case (back cover 14) to communicate with the outside, and thereby transmits sound to the outside. The sound emission opening 14*a* is rendered as a gap between the back cover 14 and the case member 11 by the notched portions disposed at the outside edge of the back cover 14 as shown in the figure, but can also be rendered as an opening disposed in the outside part of the back cover 14 itself. Sound emission openings 14*a* are preferably disposed at plural locations around the center axis, and six sound emission openings 14*a* are formed at 60 degree intervals in the example shown in the figure.

The internal filter 32 noted above is disposed parallel to the bottom of the bell 21 so that the part that functions effectively as a filter covers the entire area of the bell 21 projected onto the filter surface. The internal filter 32 is disposed adjacent to the bell 21 located thereabove in the figure, but is disposed so that it does not touch and is separated from the surface of the bell 21 by a prescribed gap Ga. The internal filter 32 is also disposed adjacent to the inside of the back cover 14 located below the internal filter 32 in the figure, but is disposed so that it does not touch and is separated from the surface of the back cover 14 by a prescribed gap Gb.

These gaps Ga and Gb depend on the frequency of the sound emitted by the bell 21, but in the example shown in the figure are preferably in the range of 0.3 to 3.0 mm, and further preferably in the range 0.5 to 1.5 mm. Attenuation of the reverberations can be reduced by setting these gaps Ga and Gb in these ranges.

Figure 2:
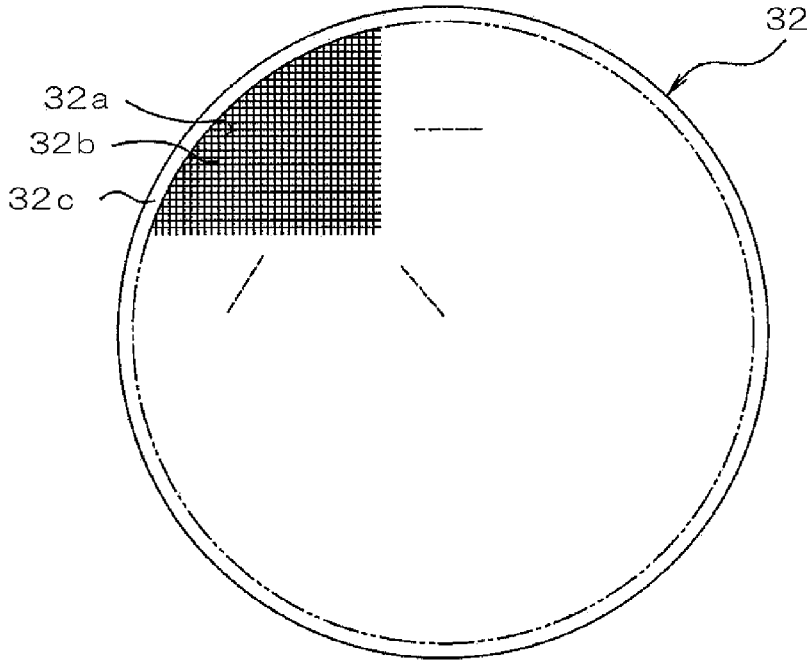
FIG. 2 is a plan view of an internal filter used in the same embodiment.

FIG. 2 is a plan view of the internal filter 32 in this embodiment of the invention. The internal filter 32 is a round metallic thin film approximately 5 to 500 μm thick and preferably approximately 5 to 50 μm thick. A metal thin film that is 32 mm in diameter and 20 μm thick is shown in this example. The metal thin film can be made by various methods, including electrocasting, vapor deposition, and sputtering. The internal filter 32 is not limited to metal materials, but the openings described below can be formed more easily and precisely by etching, for example, if a metal material is used. Metal materials such as rhodium, nickel, chrome, platinum, silver, and gold can be used, but highly malleable metals such as rhodium, gold, and platinum are preferable. A base metal such as nickel with a surface plating of another metal such as rhodium can also be used.

A large number of small holes 32*a* are formed with a substantially uniform distribution in this metal thin film, rendering a porous metal film. The small holes 32*a* are all substantially the same size and shape and arranged at a constant density. The equivalent circular diameter (the diameter of a circle having the same open area) of these small holes 32*a* is preferably 10-500 μm, and further preferably 30-80 μm. The open area of the part that functions as a filter (the part other than outside edge portion 32*c*) is preferably in the range of 60% to 80% in order to balance rigidity and sound emission performance.

The porous metallic film shown in the figure is a lattice mesh that is 10 μm thick, has square holes measuring 50 μm per side, a wire width of 8 μm, and an open area of 74%. The small holes 32*a* are formed at a constant density except at the 32*c*. The 32*c* is flat and thereby holds the strength (rigidity) of the internal filter 32. The shape of the small holes 32*a* is as desired, is not limited to the square shape shown in the figure, and could be round, oval, or polygonal. The shape, diameter, and density of the small holes 32*a* must assure waterproofness under prescribed pressure conditions while affording sufficient sound transmission, and must be at least sufficiently waterproof that no water passes when in contact with water for ten minutes at normal pressure. "Normal pressure" as used herein is equivalent to thermodynamic standard pressure, that is, 1 bar ($=10^5$ Pa) or 1 atm (=101,325 Pa), and the internal filter 32 must assure waterproofness at least a pressure of $10^5$ Pa or 101,325 Pa. If this prescribed pressure is low, waterproofness is determined by the surface condition of the internal filter 32 (the water repellency of the surface) and the surface tension of water, and as the repellency of the surface of the metal mesh increases, waterproofness improves (the waterproofable pressure rises) or waterproofness can be assured even if the hole diameter of the small holes 32*a* increases.

The surface of the metal thin film itself may offer a degree of water repellency, but in this embodiment of the invention the surface of the metal mesh film is treated for water repellency. An example of water repellency treatment is to form a water repellent coating including a fluororesin (such as Super Rain X (trademark of Nishikinodo, K.K., Japan)) on the surface. Preferably both sides of the metal mesh film are treated for water repellency, but it is sufficient to treat at least the side towards the sound emission opening 14*a* (the bottom side as seen in the figure, that is, the side facing the back cover 14). This water repellent treatment is also preferably applied to the inside surface of the back cover 14. This also makes eliminating water on the inside surface of the back cover 14 through the sound emission opening 14*a* easier.

This embodiment of the invention affords a drip-proof timepiece that is waterproof to 10 cm. More specifically, the timepiece can be immersed in 10 cm of water for ten minutes without water penetrating inside. A timepiece with even greater waterproofness, such as being waterproof to 2 or 3 atm, is also possible depending on the relationship between the water repellency of the internal filter 32 and the diameter of the small holes 32*a*.

The water repellency of the internal filter 32 was measured. To measure water repellency, the contact angle was measured using a DropMaster 500 contact angle meter manufactured by Kyowa Interface Science Co., Ltd. Using a droplet method, 2 μl of droplets were deposited onto the surface of the internal filter 32 (metal), the contact angle was measured at 0.1 sec to 10 sec intervals, the average was calculated, and the average contact angle was used as the measurement.

The contact angle before water repellent treatment was 80.2°, and the contact angle after repellent treatment was 116.2°. After water repellent treatment followed by heat treatment repeating a heat cycle of 60° C. and relative humidity of 90% for two hours followed by -20° C. for two hours four times, there was substantially no change in the contact angle, which was 115°. In addition, the contact angle was 110.6° and sufficient water repellency was maintained even after immersion in human sweat followed by exposure to 40° C. and 90% relative humidity for 24 hours.

Water resistance was also measured using a timepiece with this internal filter 32 installed immersed in water and motionless. Water entered at a depth of 25 cm when the internal filter 32 was not treated for water repellency, but water resistance was maintained to a water depth of 1 m after water repellency treatment. Water also entered at a water depth of 35 cm after water repellency treatment when there was dust adhering to the internal filter 32. Adherence of the dust was considered to have produced a capillary action where the dust adhered, and this allowed water to pass through the small holes 32*a* and enter.

Embodiment 2

If dust or other foreign matter adheres to the internal filter 32 as described above, capillary action at the foreign matter tends to allow water to pass. The second embodiment of the invention therefore modifies the foregoing arrangement by disposing two internal filters 32 with a gap therebetween between the bell 21, i.e., the sound source, and the sound emission opening 14*a* as shown in FIG. 6.

Figure 6:
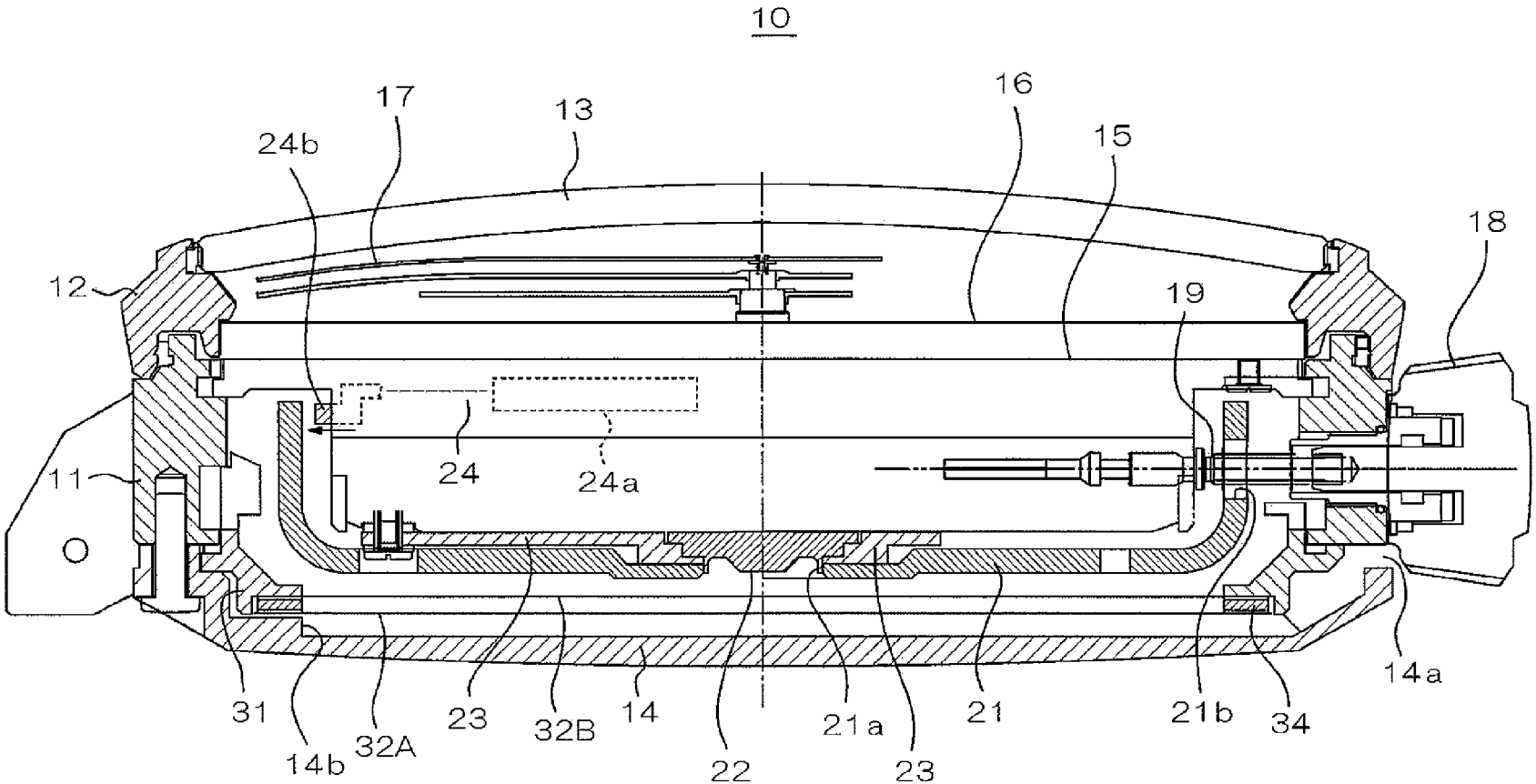
FIG. 6 is a section view showing the structure of a second embodiment of the invention.

The left side of the perpendicular denoted by a dot-dash line in the center of FIG. 6 shows a section view in the 12:00 to 6:00 o'clock direction of the timepiece, and the right side of the perpendicular shows a section view through the 3:00 o'clock direction of the timepiece. Note that like parts in this and the first embodiment are identified by like reference numerals, and further description thereof is omitted below.

In this embodiment of the invention two internal filters 32A and 32B are affixed with a gap therebetween to the case ring 31. Each of these internal filters 32A and 32B is configured the same as the above internal filter 32. As in the first embodiment the internal filters 32A and 32B are disposed horizontally inside the case member 11. More specifically, an annular spacer 34 intervenes between the outside edge part of the inside internal filter 32A and the outside edge part of the outside internal filter 32B, and the inside internal filter 32A and the outside internal filter 32B are disposed parallel to each other and attached to the case ring 31. In the example shown in the figure the outside edge part of the inside internal filter 32A, the spacer 34, and then the outside edge part of the outside internal filter 32B are attached in this order to the case ring 31 by means of double-sided adhesive tape intervening between each of the adjacent members.

The invention is not so limited, however. For example, the outside edge part of the inside internal filter 32A and the outside edge part of the outside internal filter 32B can be respectively attached by an adhesive, for example, to the inside surface (the top as seen in the figure) and the outside surface (the bottom as seen in the figure) of the inside edge part of the case ring 31.

The gap between the inside internal filter 32A and the outside internal filter 32B is sufficient to prevent dust or other foreign matter adhering to one internal filter from contacting the other internal filter. This gap is preferably in the range 10 μm to 3.00 mm, and further preferably in the range 30 μm to 1.0 mm. Exceeding this range increases the thickness of the timepiece 10, and a gap less than this range allows dust or other foreign matter adhering to one internal filter 32 to also touch the other internal filter, and thus tends to reduce waterproofness.

By having a plurality of internal filters 32A and 32B separated by a gap, this embodiment of the invention prevents a drop in waterproofness caused by foreign matter adhering to one internal filter (particularly the outside internal filter 32A) by means of the other internal filter (the particularly the inside internal filter 32B). While two internal filters is optimal, three or more internal filters may be used if there is no interference with sound emission and compactness.

Arrangement of the Sound Emission Openings

Figure 7:
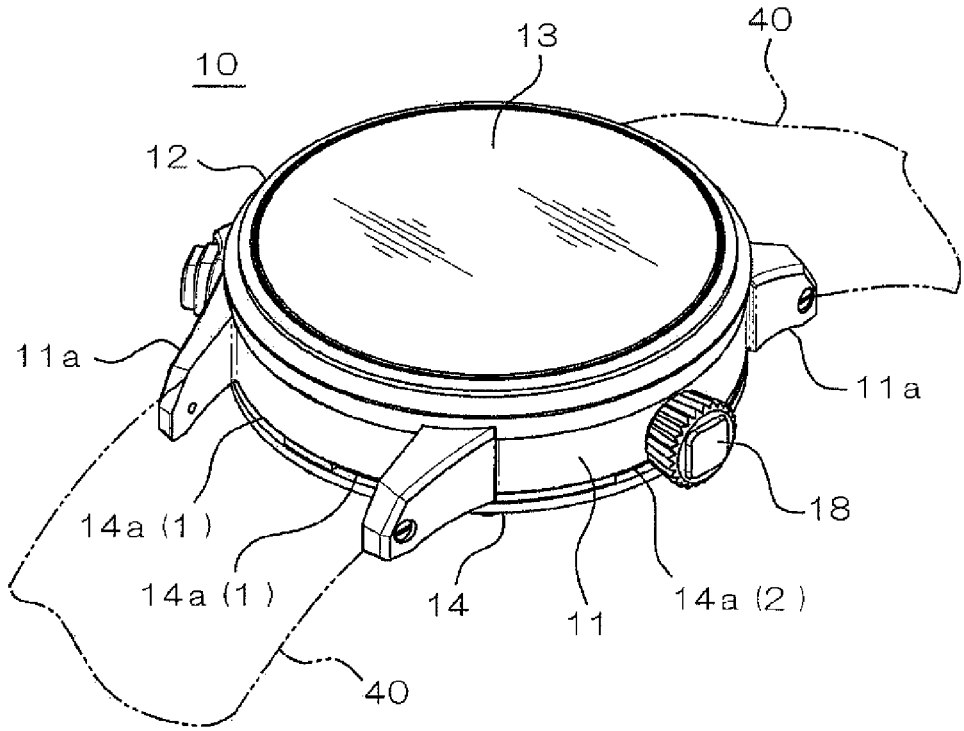
FIG. 7 is an oblique view showing the appearance of a wristwatch to which the embodiments of the invention can be applied.
Figure 8:
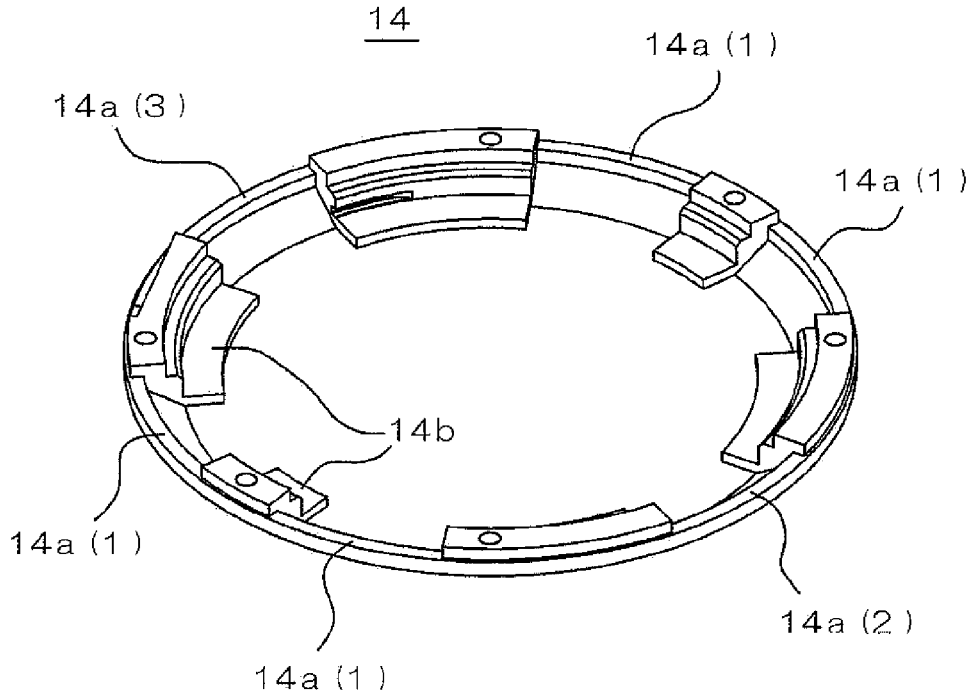
FIG. 8 is an oblique view showing the appearance of a back cover to which the embodiments of the invention can be applied.

The location of the sound emission openings 14*a* in the above embodiments of the invention are described below with reference to FIG. 7 and FIG. 8. FIG. 7 is an oblique view showing the timepiece 10 in the above embodiments, and FIG. 8 is an oblique view of the back cover 14.

Band attaching units (lugs) 11*a* are disposed to the case member 11 of the timepiece 10, and a timepiece band 40 is attached to the lugs 11*a*. The sound emission opening 14*a* is rendered by notched parts disposed to the outside edge of the back cover 14 as described above, and a plurality of sound emission openings 14*a* are dispersed around the center axis of the back cover 14. Of the plural sound emission openings 14*a*, one set of sound emission openings 14*a*(1) is disposed behind the timepiece band 40. One of the remaining sound emission openings 14*a*(2) is located behind the part where the operating member 18 protrudes, and the other remaining sound emission opening 14*a*(3) is located substantially diametrically opposite this sound emission opening 14*a*(2).

The plural sound emission openings 14*a* are thus open to the side at the outside edge of the case member, and can thus efficiently emit sound even when the timepiece 10 is attached to the wrist, for example, by the timepiece band 40. Furthermore, the sound emission openings 14*a* can be made inconspicuous by locating them on the underside in the thickness direction at the outside edge of the case member. The sound emission openings 14*a*(1) and (2) are particularly difficult to see from the outside and thus even more inconspicuous because they are located below the timepiece band 40 and the operating member 18.

Embodiment 3

Figure 3:
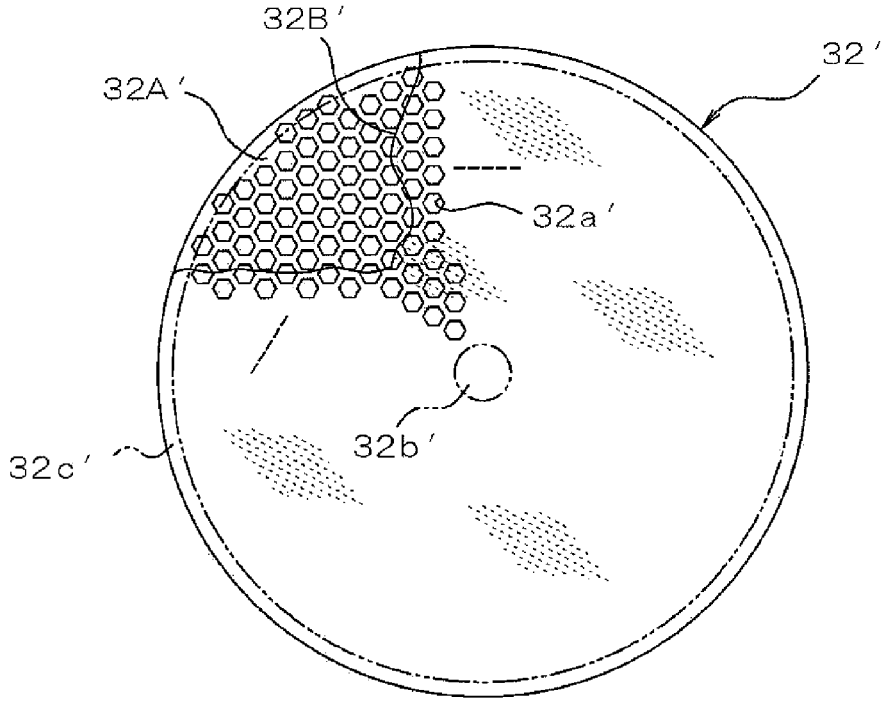
FIG. 3 is a plan view of an internal filter used in a third embodiment of the invention.

FIG. 3 is a plan view of an internal filter 32' according to a third embodiment of the invention. This third embodiment of the invention is identical to the first embodiment except for the arrangement of the internal filter, and further description of like parts is omitted below.

The internal filter 32' in this embodiment of the invention has a mesh support member 32A' layered with a gas permeable plastic film 32B', and the plastic film 32B' is supported by the mesh support member 32A' from the inside (the opposite side as the sound emission opening 14*a*).

The mesh support member 32A' is metal mesh, for example, similar to a screen having an effectively uniform distribution of openings 32*a*'. The thickness of this mesh support member 32A' is preferably 50 μm to 5 mm, and the equivalent circular diameter of these openings 32*a*' is preferably 0.1-2 mm. The shape of the openings 32*a*' is not specifically limited, and may be round or polygonal. In the example shown in the figure the thickness is 100 μm, the openings 32*a*' are regular hexagons having a distance between opposite sides of 800 μm, and the openings 32*a*' are arranged so that the plane is filled to the maximum density with the openings 32*a*' 25 μm apart. To maintain sufficient strength to support the plastic film 32B', the openings 32*a*' are not formed in the center area 32*b*', (a circular area with a diameter of 3 mm around the center point) and the outside edge portion 32*c* (an area extending from the outside edge radially to the inside with a width of 500 μm). The open area of the part that functions as the filter of this internal filter 32 (the part not including the outside edge portion 32*c*') is approximately 60%. This open area is generally preferably in the range 50% to 80%.

The plastic film 32B' is a low density polyethylene film that is 5-50 μm thick and preferably 7-20 μm thick, and is typically 10 μm thick. For example, a low density polyethylene that is 10 μm thick, has oxygen permeability of 13,000 cc/$m^2$-day*atm, moisture permeability of 30 g/$m^2$-day, and tear strength of 150 cN can be used. In addition to low density polyethylene, other materials that can be used as a gas permeable plastic film include polypropylene, PVC, and polymethylpentene.

The mesh support member 32A' and the plastic film 32B' can be simply placed together and then fastened to each other at the outside circumference part, and the parts that function as the filter do not have to be in contact with each other. The plastic film 32B' can be a single layer of film or plural layers of plastic film stacked together.

When the internal/external pressure difference changes gradually, the gas permeable plastic film 32B' of this internal filter 32' reduces the pressure difference, and when the internal/external pressure difference changes sharply, support by the mesh support member 32A' from the inside prevents damage (deformation and tearing) to the plastic film 32B'.

Using a single plastic film 32B' without using the mesh support member 32A' in the internal filter 32' also assured drip-proof level (waterproof when immersed at a water depth of 10 cm for 10 min) waterproofness. However, by providing the mesh support member 32A' to support the plastic film from the inside, waterproofness sufficient for everyday use, that is, waterproofness to 2-3 atm, can be assured.

The sound permeability and the waterproofness of the internal filter 32' according to this embodiment of the invention were tested as described below. Samples were prepared using as the plastic film 32B' (a) a single layer of low density polyethylene film ("single-ply polyethylene" below) 10 μm thick, (b) a laminated film 10 μm thick having a single layer of low density polyethylene and two layers of polypropylene laminated directly together by coextrusion, for example, (referred to below as a "PE1+PE2" film, generally having a polypropylene layer laminated on front and back sides of the polyethylene layer), and (c) a laminated film 10 μm thick having a single layer of low density polyethylene and four layers of polypropylene similarly laminated (referred to below as a "PE1+PE4" film, generally having two polypropylene layers laminated on front and back sides of the polyethylene layer with the polypropylene layers on the inside and the polypropylene layers on the outside of different compositions).

Samples in which the internal filter 321 consisted of only the plastic film 32B' and samples in which the internal filter 32' had the plastic film 32B' supported by a mesh support member 32A' as described above were also tested.

The sound permeability of the plastic film 32B' alone (single-ply polyethylene, PE1+PE2, and PE1+PE4) was measured first. The results are shown in Table 1. "No filter" in the table shows the sound pressure measured directly without passing through the plastic film. While the sound pressure gradually drops as the number of layers increases, the drop was limited to approximately 2-3 dB compared with no filter. This demonstrated that a sufficient sound emission characteristic can be achieved even using a laminated film.

TABLE 1

| Internal filter material | Sound pressure (dB) | | | | | Avg |
|---|---|---|---|---|---|---|
| no filter | 61 | 60 | 61 | 62 | 62 | 61.2 |
| single-ply polyethylene | 59 | 59 | 59 | 58 | 59 | 58.8 |
| PE1 + PP2 | 58 | 58 | 59 | 59 | 59 | 58.6 |
| PE1 + PP4 | 58 | 58 | 59 | 57 | 58 | 58.0 |

The water pressure resistance of the 32B was tested next. The results of this test are shown in Table 2. All samples were waterproof to the water pressure (static pressure) at a water depth of 10 cm, but the single-ply polyethylene leaked at 0.1 atm. The PE1+PE2 filter was waterproof to 2 atm, and the PE1+PE4 film was waterproof to 2.5 atm. It was thus confirmed that waterproofness practical for daily use can be achieved by using a laminated film even if the internal filter is composed of only the plastic film 32B' without using the mesh support member 32A'.

TABLE 2

| | Water depth or pressure | | | | | |
|---|---|---|---|---|---|---|
| Internal filter material | 10 cm | 0.1 atm | 0.5 atm | 1.0 atm | 1.5 atm | 2.0 atm |
| single-ply polyethylene | OK | NG | | | | |
| PE1 + PP2 | OK | OK | OK | OK | OK | OK |
| PE1 + PP4 | OK | OK | OK | OK | OK | OK |

When the plastic film 32B' was supported on the inside by the mesh support member 32A', even the single-ply polyethylene was waterproof to 2 atm, the PE1+PE2 film was waterproof to 3 atm, and the PE1+PE4 film was waterproof to 5 atm. Waterproofness can thus be further improved by using the mesh support member 32A'.

TABLE 3

| | Water depth or pressure | | | | | |
|---|---|---|---|---|---|---|
| Internal filter material | 0.5 atm | 1.0 atm | 2.0 atm | 3.0 atm | 4.0 atm | 5.0 atm |
| single-ply polyethylene | OK | OK | OK | NG | | |
| PE1 + PP2 | OK | OK | OK | OK | NG | |
| PE1 + PP4 | OK | OK | OK | OK | OK | OK |

The laminated internal filter having a plurality of plastic film layers can be simply a stack of plural plastic films, but a laminated film that is rendered in unison by bonding adjacent layers together as described above is preferable. Examples of such laminated films include RoseWrap (product name) from C. I. Kasei as a single-ply polyethylene film, WanWrap (product name) from Nippon Paper Pak as the PE1+PE2 film described above, and Heat Resistant WanWrap (product name) from Nippon Paper Pak as the PE1+PE4 film described above.

Sound Emission Characteristic

Figure 4:
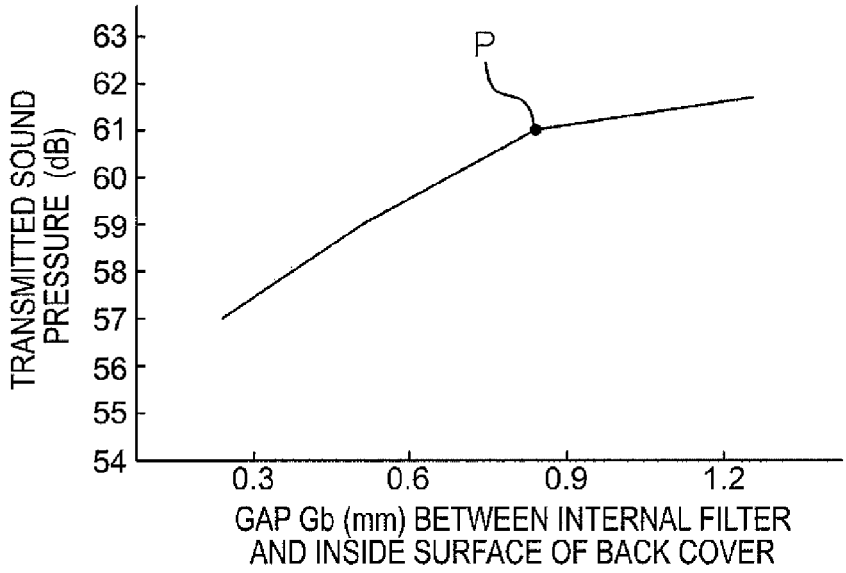
FIG. 4 is a graph showing the relationship between transmitted sound pressure and gap Gb in the first embodiment of the invention.

How much of the sound emitted from the bell 21 used as the sound source is emitted was measured using the internal filters 32 and 32' shown in FIG. 2 and FIG. 3 in the first and third embodiments. The results are shown in FIG. 4. The transmitted sound pressure that was observable outside the sound emission opening 14*a* (at a constant position) was measured with the gap Ga fixed at 0.8 mm while varying the gap Gb between the internal filter 32 and 32'.

As shown in the figure, when the gap Gb is less than or equal to 0.8 mm, the transmitted sound pressure rises sharply (that is, the rate of change is great) as the gap Gb increases, but when the gap Gb is greater than 0.8 mm, the change in the transmitted sound pressure is less even if the gap Gb increases (that is, the rate of change decreases).

In general, there is a critical point P at which the rate of change in the transmitted sound pressure to the gap Gb, which is the distance between the internal filters 32 and 32' and the inside of the back cover 14, drops, and the transmitted sound pressure can be increased if the gap Gb is set equal to or greater than the value of this critical point P. More particularly, if the gap Gb is set to the value of this critical point P, a thin timepiece can be achieved while assuring the desired sound emission performance.

The critical point P at which the rate of change in the transmitted sound pressure drops varies according to the frequency of the bell 21, that is, the sound source. The size of the gap Gb at the critical point P in the figure is 0.8 mm, but the critical point P is generally in the range of 0.3-3.0 mm, and more particularly in the range 0.5-1.2 mm.

Figure 5:
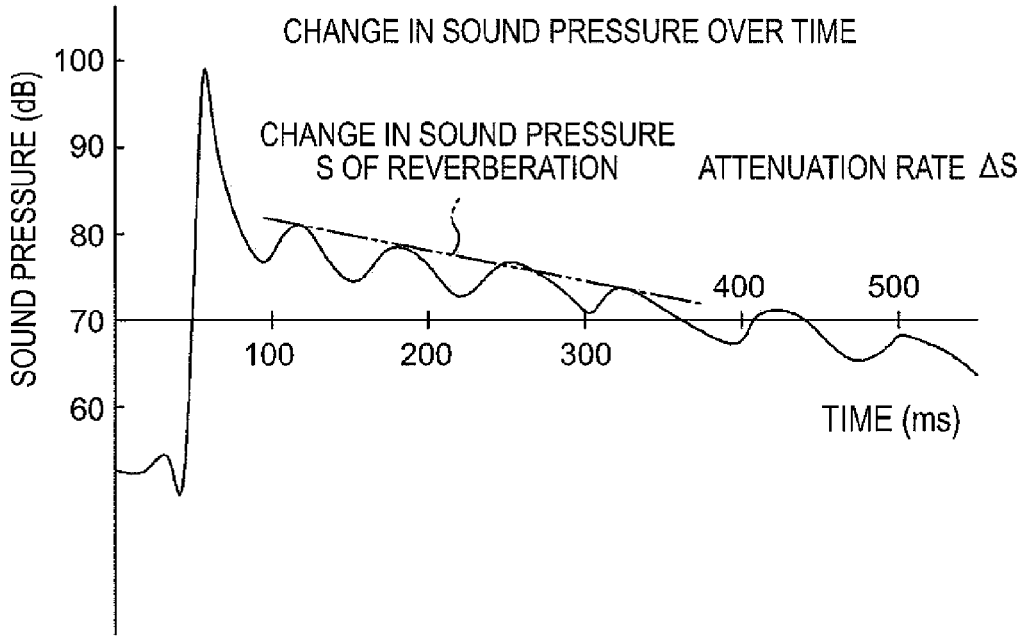
FIG. 5 is a graph showing the change in sound pressure over time in the first embodiment of the invention.

FIG. 5 shows the results of measuring the change over time in the sound pressure that is observable outside the sound emission opening 14*a* after striking the bell 21 with the striking mechanism 24 in the foregoing embodiments of the invention.

When the bell 21 is struck a high sound pressure of approximately 87-100 dB is observed, after which reverberations or echoes with a relatively low sound pressure are observed until they gradually die. The attenuation rate (the slope ΔS of sound pressure change S of the reverberation denoted by the double-dot dash line in the figure) in the sound pressure of these reverberations or echoes was determined. When an internal filter was not used, the attenuation rate of the reverberation was 35.6 dB/sec, when the internal filter 32 described above was used the attenuation rate was 20 dB/sec, and when the internal filter 32, described above was used the attenuation rate was 22 dB/sec. The initial sound pressure is obviously greater when there is no internal filter.

Because the attenuation of reverberations at a low sound pressure level is less when the internal filter of the invention is used than when the internal filter is not used, waterproofness can be assured while actually increasing the sound emission at a low sound pressure level instead of sacrificing sounds at a low sound pressure level. The invention is not limited to the arrangements shown in the figures, and the attenuation rate of reverberations can generally be suppressed to 25 dB/sec or less by using an internal filter arrangement such as described above.

The timepiece of the present invention is not limited to the foregoing embodiments, and can be varied in many ways without departing from the scope of the accompanying claims. For example, the invention is described above using by way of example an analog timepiece having a movement and hands, but the invention is not limited to this type of sound source and can be a timepiece having a timepiece circuit and a display device such as a liquid crystal display.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The entire disclosure of Japanese Patent Application Nos: 2006-227617(filed Aug. 24, 2006 and 2007-144618, filed May 31, 2007 are expressly incorporated by reference herein.

What is claimed is:

1. A timepiece comprising:

an external case;

a sound source disposed inside the external case;

an internal filter that is gas permeable and waterproof and is disposed adjacent with a gap to the external case and the sound source; and a communication opening that communicates the space between the external case and the internal filter with the outside, the internal filter being a porous thin film that has a large number of small holes and assures waterproofness preventing water from passing the small holes for at least ten minutes when in contact with water at normal pressure.

2. The timepiece described in claim 1, wherein a surface of the porous film is treated for water repellency.

3. The timepiece described in claim 1, wherein the porous film is a metal porous film having the small holes formed in a metal thin film.

4. The timepiece described in claim 1, wherein a plurality of the internal filters are disposed between the sound source and the communication opening with a gap between the internal filters.

5. The timepiece described in claim 1, wherein the sound source includes:

a bell, and a striking mechanism for striking and causing the bell to vibrate.

6. The timepiece described in claim 5, wherein the attenuation rate of reverberations produced by the bell and measured outside the communication opening is less than or equal to 25 dB/sec.

7. The timepiece described in claim 1, wherein the internal filter is disposed opposite a back cover, which is a part of the external case, and the communication opening is disposed at the outside circumference part of the back cover or between the back cover and another external case member.

8. The timepiece described in claim 7, wherein the gap between the internal filter and the back cover is greater than or equal to the value of the critical point at which the rate of change in the transmitted sound pressure emitted from the communication opening relative to the gap drops.

9. A timepiece comprising:

an external case;

a sound source disposed inside the external case;

an internal filter that is gas permeable and waterproof and is disposed adjacent with a gap to the external case and the sound source; and a communication opening that communicates the space between the external case and the internal filter with the outside, the internal filter including a mesh-shaped support member, and a resin film that is gas permeable and is supported by the mesh-shaped support member from the inside.

10. The timepiece described in claim 9, wherein the resin film is low density polyethylene.

11. A timepiece comprising:

an external case;

a sound source disposed inside the external case;

an internal filter that is gas permeable and waterproof and is disposed adjacent with a gap to the external case and the sound source; and a communication opening that communicates the space between the external case and the internal filter with the outside, the internal filter including a plurality of gas permeable resin film layers.

12. The timepiece described in claim 11, wherein the internal filter is a laminate of polyethylene film and polypropylene film.

* * * * *